United States Patent [19]

Chambers et al.

[11] 4,121,899

[45] Oct. 24, 1978

[54] CONDENSATION DYEING

[75] Inventors: Thomas Van Chambers, Inman, S.C.; Julian J. Hirshfeld, Gastonia, N.C.

[73] Assignee: Milliken Research Corporation, Spartanburg, S.C.

[21] Appl. No.: 774,778

[22] Filed: Mar. 4, 1977

[51] Int. Cl.[2] ..... C09B 67/00; D06P 1/64

[52] U.S. Cl. ..... 8/94 A; 8/21 A; 8/21 C; 8/25; 8/41 C; 8/177 R; 8/179

[58] Field of Search ..... 8/94 A, 41 C, 177 R, 8/179, 21 A, 21 C

[56] References Cited

U.S. PATENT DOCUMENTS

| | | | |
|---|---|---|---|
| 2,999,002 | 9/1961 | Dayvault et al. | 8/94 |
| 3,667,898 | 6/1972 | Bergman et al. | 8/94 |
| 3,762,872 | 10/1973 | Acree | 8/176 |
| 3,784,355 | 1/1974 | Fielding | 8/175 |
| 3,876,370 | 4/1975 | Birke et al. | 8/174 |
| 3,894,842 | 7/1975 | Birke et al. | 8/173 |
| 3,926,554 | 12/1975 | Schuierer | 8/174 |
| 3,988,109 | 10/1976 | Schuierer | 8/94 R |

FOREIGN PATENT DOCUMENTS 792,210 3/1958 United Kingdom.

*Primary Examiner*—A. Lionel Clingman

*Attorney, Agent, or Firm*—Robert S. Alexander; H. William Petry

[57] ABSTRACT

Fibers are dyed by applying an aqueous dyeing formulation to the fibers, cooling them and condensing halogenated hydrocarbon vapors upon the cool, wet fibers. Residual halogenated hydrocarbon is removed by exposing the fibers to heat.

35 Claims, No Drawings

CONDENSATION DYEING

BACKGROUND OF THE INVENTION

This invention relates to a method of dyeing fibers, especially polyester and other synthetic fibers.

Methods of dyeing synthetic fibers are well known in the prior art. The most commonly used method is exhaust dyeing which is a batch process and is consequently cumbersome and expensive. Fabrics which are composed of polyester and blends of polyester and other fibers have proved particularly difficult to dye. Continuous methods of dyeing texturized polyester and polyester blends have long been sought because of their economic advantages. It is, therefore, an object of the present invention to provide a method of dyeing fabrics containing polyester in a continuous process which does not distort the hand and drape of the fabric.

PRIOR ART

U.S. Pat. No. 3,762,872 to Acree discloses a process for continuously dyeing polyester fabrics which includes the steps of applying a dyestuff to the fabric, drying the fabric, cooling the fabric to room temperature, exposing the fabric to saturated solvent vapors at the boiling point of the solvent, then exposing the fabric while it is still wet to the superheated vapors of the same solvent. The fabric is then scoured and dried.

U.S. Pat. No. 3,988,109 to Schuierer discloses a process for dyeing polyester including the steps of impregnating the fabric with an aqueous dye liquor and then exposing the material to air enriched with the halogenated hydrocarbon having a boiling point which is below 85° C. In his single Example, Schuierer specifies a treatment time of 4 hours for the dyeing of the material. After fixation, the material is treated with water and is finished by rinsing and drying.

High temperatures have been required in other previously known methods of dyeing synthetic fibers. These high temperatures result in various ill effects. Such effects include degradation of the hand of the fabric and the formation of oligomers, especially trimers, due to the high temperatures involved. Such oligomer formation leads to uneven dyeing and defects in the surface appearance of the material. Further, oligomers often are deposited on the walls of the dyeing vessels and clog the pipes of the heat exchangers.

The method of the present invention is particularly suitable for dyeing fabrics which are blends of polyester and acrylic. The principal method known to the prior art of dyeing such fabric is yarn dyeing in which the acrylic yarn and the polyester yarn are each dyed separately. The yarns are then woven or knitted together to form a single piece of fabric. By use of the present invention, it is possible to dye such fabric after the yarns are woven or knitted into the fabric, rather than dyeing the yarns separately. This is called piece dyeing. Acrylic fibers are normally dyed by the use of basic dyestuff, while polyester fibers are normally dyed using disperse dyes. By incorporating both kinds of dyes into the dyeing composition, it is possible to obtain in a single dyeing step an evenly dyed blend of acrylic and polyester. When disperse and basic dyestuffs are incorporated into the same dyeing formulation, it is often advantageous to include a coacervating agent to prevent undesirable reactions between the two dyestuffs. Such coacervating agents are well known to those who are skilled in the dyeing art and include such products as Tinegal APC which is a non-ionic mixture of a polyethoxylated fatty alcohol and an ethoxylated amine which is sold by Ciba-Geigy. Another is Chemcogen 132-N which is an ethoxylated amine sold by Chemical Processing of Georgia.

If piece dyeing is attempted using the methods commonly known in the prior art, the polyester fibers in the fabric would not exhibit the same depth of color that the acrylic fibers in the fabric would exhibit. Since the use of the halogenated hydrocarbon greatly increases the depth of color obtained by the polyester, it becomes possible to piece dye both fibers to the same depth of color by using the present invention.

In accordance with the present invention, the fibers are first impregnated with a dyeing formulation containing water, dyestuff, and thickener. Advantageously, soil release finish, anti-migrating compounds and pH buffers may be added. The fibers may be impregnated by any method including immersion, spraying, padding, dipping or any other method which places sufficient dyeing formulation on the fibers.

The preferred dyeing formulation to be used in the present invention comprises dyestuff, soil release finish, anti-migrating compounds, and pH buffers. It may also comprise other fabric finishing agents such as antistatic, antipilling, water repellent, or other desirable additives. While the method of the present invention will provide an increased yield with any suitable dye, including basic and anionic dyes, it is best suited to disperse organic dyes. The most preferred dyes are the azo and anthraquinone dyes. When disperse dyes are used, it is often advantageous to add an antimigrant to the dyeing compound. Such antimigrants lessen the tendency of the dyestuff compound to migrate after application. Many of the compounds which serve as antimigrants also will serve as thickeners and promote adhesion of the dyeing composition to the fibers. Thus, it is often possible to use a single compound as both a thickener and as an antimigrant. The thickeners are divided into natural thickeners and synthetic thickeners, both of which can be used. Natural thickeners would include gums, the extract of locust beans, starches, gum arabic, guar gum, alginates and the like. Synthetic thickeners include polyacrylic acids, ethylene maleic anhydride and the like. Polyacrylic acids and alginates are also useful as antimigrating compounds. When disperse dyes are used, it may also be advantageous to add a leveling agent to the dyestuff compound to promote more even dyeing. Any standard surfactant can serve as a leveling agent. Suitable penetrating agents include aliphatic alcohols, aromatic alcohols, phosphor esters, and the like.

The preferred embodiment is a continuous operation in which the dyeing formulation is applied to the exterior of the fabric by immersion in a dyeing compound bath at approximately room temperature or below. Shortly, after immersion in the dyestuff bath, the fabric is cooled, preferably by introduction into a cooling chamber which is advantageously maintained at a temperature of between 0° C. to −40° C. and more advantageously between −10° C. and −30° C. The fabric remains in the chamber for sufficient time to cool it preferably to below −10° C. The residence time in the cooling chamber will depend upon many factors including the structure of the fabric, the temperature of the chamber, the initial temperature of the fibers, the coefficient of convection and other factors, within the chamber. It is necessary only that the dyeing formulations impregnated upon the surface of the fiber has been sufficiently cooled to cause condensation of sufficient halogenated hydrocarbon to effect the desired degree of dyeing. However, it has been found that from 1 to 15 minutes is generally sufficient time to allow sufficient cooling of the fibers. In the most preferred embodiment, the fibers will remain in the cooling chamber for sufficient time to completely solidify the aqueous dyeing formulation which is on the fibers. By this means, the amount of halogenated hydrocarbon which condenses upon the fibers can be increased dramatically because much more heat will be required to melt the aqueous dyeing formulation because of the extra energy required to cause the change of phase to take place. Alternatively, the fibers may be cooled and then dipped in the dyeing formulation.

After the fibers leave the cooling chamber, they are introduced into a vapor chamber which has halogenated hydrocarbon vapor within it. Preferably the partial pressure of the vapors of the halogenated hydrocarbon will be at least 50% of the total pressure and more preferably over 90% of the total pressure, but it is only necessary that the partial pressure of the halogenated hydrocarbon be high enough to ensure that sufficient halogenated hydrocarbon will condense on the fibers in the vapor chamber. Thus, lower partial pressures of halogenated hydrocarbon can be used if the temperature of the fibers is lowered, and conversely, if the temperature of the fibers is higher, then the partial pressure of the halogenated hydrocarbon should be higher. Ideally, the vapor chamber will contain pure halogenated hydrocarbon vapors. The total pressure within the vapor chamber is not critical; it may be atmospheric or above or below. The cost of equipment is minimized if the chamber operates at atmospheric pressure, however the speed of the process may be increased if the pressure in the vapor chamber is increased.

Preferably, the vapors are formed by heating the halogenated hydrocarbon to its boiling point at the operating pressure of the chamber. The fibers pass through the vapors of the halogenated hydrocarbon which condense on the fiber causing a sudden swelling of the fibers which presumably then allows a full absorption of the dyestuff which was deposited in the impregnation step. The fibers are retained within the vapor chamber for sufficient time to allow both condensation of sufficient halogenated hydrocarbon to cause swelling of the fibers and full absorption of the dyestuff.

Preferred halogenated hydrocarbons for the practice of the present invention boil at temperatures of between 25° and 65° C. The halogenated hydrocarbons should also be liquids at room temperature, although this is not absolutely essential. Suitable halogenated hydrocarbons include but are not limited to methylene chloride, ethylene chloride, vinylidene chloride, dichloroethane, bromochloromethane, bromodichloromethane, iodomethane, chloroform and the like. Many other suitable halogenated hydrocarbons will be apparent to those skilled in the art. Preferred halogenated hydrocarbons include methylene chloride, ethylene chloride, methylene bromide, ethylene bromide, dichloroethene, chloroform and vinylidene chloride.

Less care is required in the use of methylene chloride and chloroform and these are the more preferred hydrocarbons for use in accordance with this invention. While both will promote even, colorfast dyeing, methylene chloride seems to cause the dyestuff to penetrate further into the fibers. It is believed that this is due to the pronounced tendency of methylene chloride to swell the fibers of polyester; therefore, it is the most preferred halogenated hydrocarbon, both because of its low cost and its powerful swelling effect upon polyester. It is also highly desirable that the halogenated hydrocarbon used be easily vaporizable and easily condensible so that it can be recovered after the fabric has been treated with it. For this reason, the halogenated hydrocarbons which have low latent heats of vaporization and boil in the range of 25°–65° C. are preferred over those which have high latent heats and boil at higher or lower temperatures.

After the desired depth of color has been obtained, the fibers are heated advantageously by introduction into a heating chamber at a temperature which is preferably near the boiling point of the halogenated hydrocarbon although higher temperatures are satisfactory. The fibers remain in the heating chamber for a sufficient time to evaporate most of residual halogenated hydrocarbon. Normally, the fibers remain within the heating chamber for about 1 to 3 minutes or long enough to evaporate the residual halogenated hydrocarbon in the fibers. Preferably, the temperature of the heating chamber will be below 100° C. but as high as is possible while avoiding localized boiling of the halogenated hydrocarbon within the fibers. The localized boiling can be tolerated, but it is preferably avoided. After heating, the fibers may be steamed. It is thought that steaming may aid in setting the dye as well as helping to remove residual halogenated hydrocarbon. Heating and steaming can be combined into one step. Standard scouring, rinsing and drying operations are then performed on the fibers.

The following examples are provided in order to more fully illustrate the present invention; however, they are to be understood to be merely examples and not to limit the scope of the invention.

EXAMPLE I

A polyester fabric was dyed yellow using the method of the present invention. The fabric was a double knit twill of false twist textured Type 56 Dacron, 150 denier 34 filament yarn having a weight of 12 ounces per yard. A dyeing formulation was prepared by dissolving 20 grams per liter of Latyl Yellow 3G-paste (Color Index-Disperse Yellow 54) in water. To this was added 2 grams per liter of a synthetic thickener based on carboxypoly methylene and sold by Catawba-Charlab as Catasperse BKN-3. A chelating agent known as Sequestrene ST which is Ciba-Geigy's trade name for tetrasodium ethylene diamine tetraacetate dihydrate was added in the amount of 0.1 grams per liter and 0.2 grams per liter of acetic acid were added to produce a slightly acidic condition in the bath.

The dyeing formulation bath was maintained at a temperature of approximately 70° F. ± 2° F. The fabric was immersed in the bath and the pickup of dyeing formulation bath was approximately 110% of the weight of the fabric. The wet fabric was cooled in a cooling chamber at a temperature of approximately 4° F. where it remained for 6 minutes. The cool, wet fabric was exposed to methylene chloride vapor for 9 minutes. The dye was set and residual methylene chloride was removed by steaming the fabric for 6 minutes. The fabric was scoured and dried on a tenter frame. The samples were shown to be level dyed with good colorfastness. Photomicrographs showed good penetration of the dyestuff into the fibers. When tested according to American Association of Textile Colorists and Chemists Standards, the following results were obtained:

| Test | Rating |
|---|---|
| 20 hour lightfastness | 4.5 |
| 40 hour lightfastness | 4.5 |
| Dry Clean | 4.0 |
| Wash(IIA) | 3.5 |
| Sublimation 350° - 30 sec. | 4.0 |
| Sublimation Sublimation 365° - 30 sec. | 3.5 |
| Dry Crock | 4.0 |
| Wet Crock | 4.5 |
| Acid Perspiration | 4.5 |
| Solvent Bleed | 4.5 |

EXAMPLE II

The procedure of Example I was followed except that the dyestuff used was 20 grams per liter of Latyl Cerise NSN (Color Index-Disperse Red 60) in the form of a 50% paste. The samples were also shown to be level dyed with good colorfastness and good penetration of the dyestuff into the fibers. The AATCC tests yielded the following results:

| Test | Rating |
|---|---|
| 20 hour lightfastness | 4.5 |
| 40 hour lightfastness | 4.0 |
| Dry Clean | 4.0 |
| Wash (IIA) | 3.0 |
| Sublimation 350° - 30 sec. | 2.5 |
| Sublimation 365° - 30 sec. | 1.5 |
| Dry Crock | 3.5 |
| Wet Crock | 4.5 |
| Acid Perspiration | 4.5 |
| Solvent Bleed | 4.0 |

EXAMPLE III

The procedure of Example I was followed except that the dyestuff used was Samaron Blue HBL paste (Disperse Blue 95). The samples again exhibited good colorfastness and good penetration of the dyestuff into the fibers. The AATCC tests yielded the following results:

| Test | Rating |
|---|---|
| 20 hour lightfastness | 4.5 |
| 40 hour lightfastness | 4.0 |
| Dry Clean | 4.0 |
| Wash (IIA) | 3.0 |
| sublimation 350° - 30 sec. | 3.5 |
| Sublimation 365° - 30 sec. | 3.0 |
| Dry Crock | 3.0 |
| Wet Crock | 4.0 |
| Acid Perspiration | 4.5 |
| Solvent Bleed | 4.5 |

EXAMPLE IV

A polyester-acrylic fabric was dyed red using the method of the present invention. The fabric was a double knit blend containing 50% 150 denier, 34 filament Type 56 textured polyester and 50% spun Acrilan 16 single 32 worsted count.

The method used was the same as Example I except that a dyeing formulation which was appropriate for polyester-acrylic blends was used. The dyeing formulation was prepared by dissolving the following in water: 50 grams per liter of Tinegal APC as a coacervating agent; 20 grams per liter of Latyl Cerise NSN (Color Index — Disperse Red 60) in the form of a 50% paste and 20 grams per liter of Intradene Red GRL powder. Intradene Red GRL has not yet been assigned a Color Index number. To this was added 3.2 grams per liter of Catasperse BKN-6 to serve as a thickener; 0.5 grams per liter of Sequestrene ST to serve as a chelating agent; 5.0 grams per liter of acetic acid to produce a slightly acidic condition in the bath; and 10 grams per liter of Merpol DA which is an ethylene oxide condensate sold by DuPont for use as a dyeing assistant.

After dyeing, the fabric was shown to be level dyed with good colorfastness. There was no apparent difference between the depth of color obtained by the acrylic and polyester fibers. When tested according to AATCC Standards, the following results were obtained:

| Test | Rating |
|---|---|
| 20 hour lightfastness | 4.5 |
| Dry Clean | 4.5 |
| Wash (IIA) | 3.0 |
| Sublimation 350° - 30 sec. | 2.5 |
| Dry Crock | 5.0 |
| Wet Crock | 5.0 |
| Acid Perspiration | 4.5 |
| Solvent Bleed | 3.5 -4.0 |

EXAMPLE V

A polyester-acrylic fabric was dyed blue using the method of the present invention. The fabric was the same as used in Example IV. The procedure used was the same except that the dyestuffs used were: 20 grams per liter of Samaron Blue HBL (Color Index — Disperse Blue 95) in the form of a 50% paste and 10 grams per liter of Sevron Blue ER powder (Basic Blue 77) in the form of a 20% powder. After dyeing, the samples were shown to be level dyed with good colorfastness and no apparent difference between the depth of color obtained by the acrylic and polyester fibers. The AATCC tests yielded the following results:

| Test | Rating |
|---|---|
| 20 hour lightfastness | 4.5 |
| Dry Clean | 4.5 |
| Wash (IIA) | 2.5 - 3.0 |
| Sublimation 350° - 30 sec | 3.0 |
| Dry Crock | 4.5 |
| Wet Crock | 4.5 |
| Acid Perspiration | 2.0 |
| Solvent Bleed | 2.5 |

We claim:

1. A method of dyeing fibers, which comprises the steps of:

applying an aqueous dyeing formulation containing a dyestuff which is suitable for dyeing said fibers to the fibers;

cooling the fibers while still wet to a first temperature;

exposing the cooled, undried fibers to vapors of a halogenated hydrocarbon having a boiling point which is higher than said first temperature, the boiling point of said halogenated hydrocarbon being between 25° C. and 65° C.; and condensing said halogenated hydrocarbon on the fibers to promote dyeing; and removing said halogenated hydrocarbon from the fibers.

2. The method of claim 1 wherein said dyeing formulation includes a thickener.

3. The method of claim 1 wherein said halogenated hydrocarbon is chosen from the group consisting of methylene chloride and chloroform.

4. The method of claim 1 wherein said halogenated hydrocarbon is methylene chloride.

5. The method of claim 4 wherein the residual halogenated hydrocarbon is removed by steaming.

6. The method of claim 1 wherein said halogenated hydrocarbon is chloroform.

7. The method of claim 1 further comprising the steps of: recovering the halogenated hydrocarbon by condensation; and recycling the recovered halogenated hydrocarbon.

8. The method of claim 1 wherein the halogenated hydrocarbon vapors have a partial pressure which is at least 50% of the total pressure and wherein the fibers are exposed to the halogenated hydrocarbon vapors for between 30 seconds and 20 minutes.

9. The method of claim 1 wherein the halogenated hydrocarbon vapors have a partial pressure which is at least 90% of the total pressure.

10. The method of claim 9 wherein the fibers are cooled to below 0° C.

11. The method of claim 9 wherein the fibers are cooled to below −10° C.

12. The method of claim 9 wherein the fibers are cooled to substantially solidify the aqueous dyeing formulation on the fibers.

13. The method of claim 1 wherein the fibers are cooled to below 0° C.

14. The method of claim 1 wherein the fibers are cooled to below −10° C.

15. The method of claim 1 wherein the fibers are cooled to substantially solidify the aqueous dyeing formulation on the fibers.

16. The method of claim 1 wherein said dyeing formulation includes:

a thickener;

wherein said halogenated hydrocarbon is chosen from the group consisting of methylene chloride and chloroform; and further comprising the steps of removing the halogenated hydrocarbon by steaming;

recovering the halogenated hydrocarbon by condensation; and recycling the recovered halogenated hydrocarbon.

17. The method of claim 16 wherein said halogenated hydrocarbon vapors have a partial pressure which is at least 90% of the total pressure, and wherein the fibers are exposed to the halogenated hydrocarbon vapors for between 30 seconds and 20 minutes.

18. The method of claim 17 wherein said halogenated hydrocarbon is methylene chloride.

19. The method of claim 18 wherein the fibers are cooled to below 0° C.

20. The method of claim 18 wherein the fibers are cooled to below −10° C.

21. The method of claim 18 wherein the fibers are cooled to substantially solidify the aqueous dyeing formulation on the fibers.

22. The method of claim 17 wherein said halogenated hydrocarbon is chloroform.

23. The method of claim 22 wherein the fibers are cooled to below 0° C.

24. The method of claim 22 wherein the fibers are cooled to below −10° C.

25. The method of claim 22 wherein the fibers are cooled to substantially solidify the dyeing formulation on the fibers.

26. A method of dyeing fabrics which are blends of polyester and another fiber, comprising the steps of:

applying an aqueous dyeing formulation to the fabric, said dyeing formulation containing a first dyestuff which is suitable for dyeing polyester and a second dyestuff which is suitable for dyeing the other fiber; and a coacervating agent;

cooling the wet fabric to a first temperature;

exposing the cooled, undried fabric to vapors of a halogenated hydrocarbon having a boiling point which is higher than said first temperature, the boiling point of said halogenated hydrocarbon being between 25° C. and 65° C. and condensing said halogenated hydrocarbon on the fabric to promote dyeing; and removing said halogenated hydrocarbon from the fabric.

27. The method of claim 26 wherein said dyeing formulation includes a thickener.

28. The method of claim 27 wherein the halogenated hydrocarbon vapors have a partial pressure which is at least 90% of the total pressure.

29. The method of claim 28 wherein said other fiber is acrylic and wherein said first dyestuff is a disperse dyestuff and said second dyestuff is a basic dyestuff.

30. The method of claim 1 wherein said halogenated hydrocarbon is chosen from the group consisting of methylene chloride and chloroform.

31. The method of claim 30 wherein the residual halogenated hydrocarbon is removed by steaming, and wherein the fibers are exposed to the halogenated hydrocarbon vapors for between 30 seconds and 20 minutes.

32. The method of claim 31 further comprising the steps of: recovering the halogenated hydrocarbon by condensation; and recycling the recovered halogenated hydrocarbon.

33. The method of claim 32 wherein the fibers are cooled to below 0° C.

34. The method of claim 32 wherein the fibers are cooled to below −10° C.

35. The method of claim 32 wherein the fibers are cooled to substantially solidify the dyeing formulation on the fibers.

* * * * *